United States Patent [19]

Julian

[11] 4,254,555

[45] Mar. 10, 1981

[54] PERSPECTIVE VIEW APPARATUS

[76] Inventor: Emile E. Julian, P.O. Box 725, Laguna Beach, Calif. 92652

[21] Appl. No.: 37,999

[22] Filed: May 11, 1979

[51] Int. Cl.[3] ..... B43L 13/14

[52] U.S. Cl. ..... 33/434

[58] Field of Search ..... 33/432, 433, 434, 18 C

[56] References Cited

U.S. PATENT DOCUMENTS

| | | | |
|---|---|---|---|
| 1,826,338 | 10/1931 | Ackerberg | 33/432 |
| 1,986,625 | 1/1935 | DeLorenzi | 33/434 |
| 2,442,117 | 5/1948 | Davis | 33/18 C |
| 2,648,908 | 8/1953 | Stone | 33/434 |
| 2,651,111 | 9/1953 | Stiebing | 33/432 |
| 2,711,024 | 6/1955 | Sachtleber | 33/434 |
| 2,854,750 | 10/1958 | Pirogow | 33/434 |
| 2,895,223 | 7/1959 | Fields | 33/433 |
| 3,226,831 | 1/1966 | Tavernier | 33/434 |
| 3,258,843 | 7/1966 | Nosser | 33/432 |
| 3,300,863 | 1/1967 | Pirogow | 33/434 |
| 3,318,003 | 5/1967 | Pirogow | 33/434 |
| 3,332,152 | 7/1967 | Dru | 33/434 |
| 3,646,683 | 3/1972 | Barzee | 33/434 |
| 3,719,995 | 3/1973 | Sauvgeau | 33/433 |

FOREIGN PATENT DOCUMENTS

| | | | |
|---|---|---|---|
| 757694 | 9/1956 | United Kingdom | 33/434 |

OTHER PUBLICATIONS

Enthymat Brochure 1968.

*Primary Examiner*—John W. Shepperd
*Attorney, Agent, or Firm*—Sherman & Shalloway

[57] ABSTRACT

The disclosed device is a combination of horizontally and vertically guided members which form an input area and an output area so that perspective views of objects in the input area are created in the output area by the projections of the visible points of the objects onto a plane perpendicular to the line of sight, along lines from the viewpoint. In the input area, a horizontally guided bar has a vertical guide therein. Two members are hinged together at a viewpoint or separately at viewpoint and modified viewpoint and the ends of the members which fall in the input area are slideably connected to the guide in the horizontally guided bar. One end of the member falls in the output area and is horizontally guided while the other end of the second member also falls in the output area and is vertically guided. An output bar system is connected to these ends to form an output point in the output area. Specifically, the horizontally guided output end is connected to a vertical output bar and the vertically guided output end is connected to a horizontal output bar. The intersection of the vertical output bar and the horizontal output bar define the output point of the device.

14 Claims, 9 Drawing Figures

PERSPECTIVE VIEW APPARATUS

BACKGROUND OF THE INVENTION

1. Field of the Invention

The invention generally relates to an apparatus for drawing perspective views and, in particular, relates to an apparatus for drawing a perspective representation of an object on the basis of ordinary drawings representing orthogonal projections, i.e. a plan view, an elevation and side views of the object.

2. Description of the Prior Art

Many types of perspective drafting instruments are known in the prior art. For example, U.S. Pat. Nos. 2,648,908; 2,651,111; and 3,226,831 disclosed different types of apparatus for drawing a perspective representation. These types of apparatus are considered to be defficient in that the representation which the apparatus provide is usually not a complete perspective and, if it is, the perspective requires a significant amount of calculation and revision.

Other types of perspective apparatus which are known in the prior art to create perspective drawings are vanishing point apparatus. These apparatus, as disclosed in U.S. Pat. Nos. 2,854,750; 3,300,863; 3,318,003; and 3,646,683, are basically a "gimmick" for making one-, two- or three-point perspective drawings which require a significant amount of calculation and changes.

SUMMARY OF THE INVENTION

The disclosed invention is distinguishable over the above examples of perspective apparatus in that it makes possible the rapid development of perspective views of obects, especially when parallel sections are readily available. In addition, the invention is relatively simple to use and make and its cost is significantly less than the prior art devices which may have performed the same function in a significantly different way. Also, the accuracy of the invention depends only upon the quality of the components used as the system described does not distort and creates an exact perspective view.

It is an object of this invention to provide an apparatus which can be easily operated by any draftsman without requiring any expert knowledge of the laws of perspective representation.

It is another object of this invention to provide an apparatus in which the plane of projection of the perspective picture may be vertical or inclined forwardly or rearwardly as desired, and in which the viewing center is adjustable to any desired elevation between wide limits thus enabling the operator to draw a perspective view of any type.

It is another object of this invention to provide an apparatus in which a plan view is fixed to one section of a drawing board forming part of the apparatus and in which a rule permitting the operator to draw the perspective view is movable on another section of the drawing board.

It is yet another object of the disclosed invention to provide an apparatus in which the location of the viewing center and the location and inclination of the plane of projection with respect to the object may be arbitrarily chosen by the draftsman so that any desired perspective views of the object may be obtained.

It is still another object of this invention to provide a perspective apparatus using a mechanical system to transform plane and solid figures into perspective views of the same figures as seen from viewpoints arbitrarily chosen.

It is another object of this invention to provide a system for drawing perspective views which allows the variance in the scale of the output perspective views.

It is a particular object of this invention to transform plan sections of objects into perspective views of these sections, for example, plan views of a building from which views of the full perspective image may be developed.

It is another particular object of the invention to disclose a perspective drawing device which is economical to manufacture.

It is yet another object of the invention to disclose a perspective device which can be quickly and efficiently used. This is in contrast to geometric construction devices which are very slow and tedious, even when employing various vanishing point aids.

It is another object of this invention to describe a perspective device which has unlimited viewpoint selection. This is in contrast to the graphic devices of the prior art, such as pre-printed perspective grids, which are limited in viewpoint selection and primarily facilitate geometric construction methods.

BRIEF DESCRIPTION OF THE DRAWING

These objects and features of the invention as well as others will become apparent to those skilled in the art by referring to the enclosed drawing in which.

DETAILED DESCRIPTION OF THE INVENTION

Figure 1:
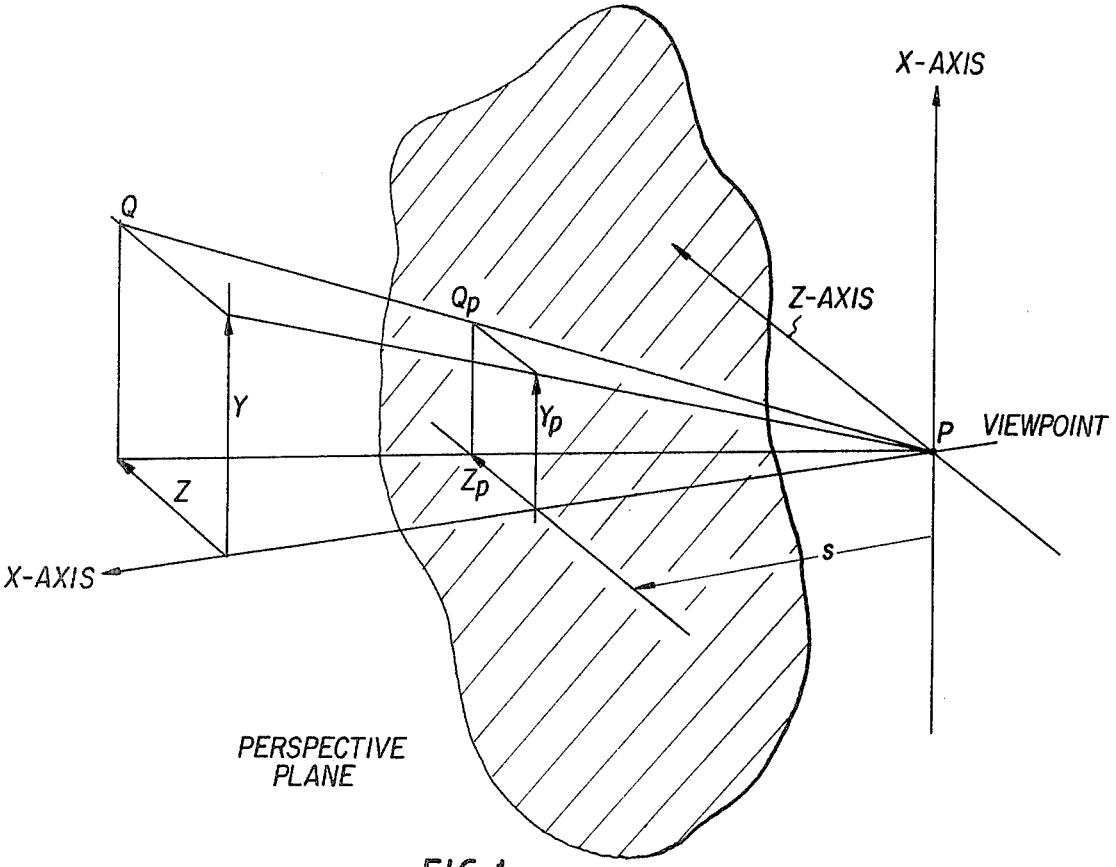
FIG. 1 is a perspective transformation of the geometry involved in a two-point perspective drawing.

Views of an object are created by the projections of the visible points of the object onto a plane perpendicular to the line of sight along lines from the viewpoint (eye of the viewer). In the apparatus disclosed herein, a mechanical computer utilizes the elementary geometric transformations of projecting points from the object onto the perspective plane. The geometry and the transformation are illustrated in FIG. 1. The line of sight is taken to be the x-axis with the viewpoint at $x=0$ and indicated by reference character P. In the "two-point" perspective view, as shown in FIG. 1, the line of sight is perpendicular to the vertical x-axis. The x, y and z axes form an orthogonal 3-dimensional coordinate system with the shaded area representing a portion of the perspective plane which is orthogonal to the x-axis and at a distance s for the viewpoint P. Reference character W denotes an arbitrary point on the object and the coordinates of object point W are (x, y, z). As object point Q traces a path on the object, the perspective view of the path is seen and traced by viewpoint P as perspective view $Q_p$ in the perspective plane. Clearly, the selection of the magnitude of the distance s amounts only to the selection of a scale factor for the perspective view. The geometry of the perspective view as illustrated in FIG. 1 results in the following relationships:

$$z/x=z_p/s \quad (1)$$

and $$y/x=y_p/s \quad (2)$$

so that the coordinates in the perspective plane are $$z_p=s(z/x) \quad (3)$$

and $$y_p=s(y/x) \quad (4)$$

Figure 3:
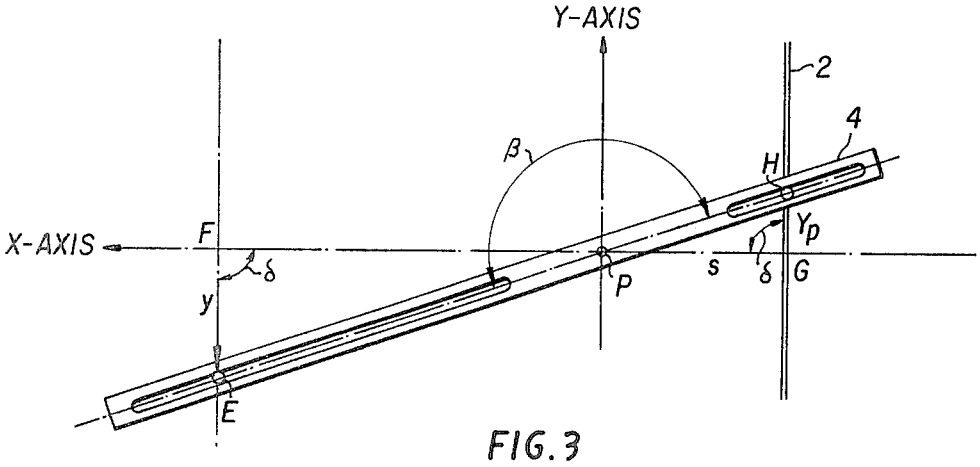
FIG. 3 is an illustration of a $y_p$ mechanism which transforms the y dimension and the $y_p$ dimension.
Figure 4:
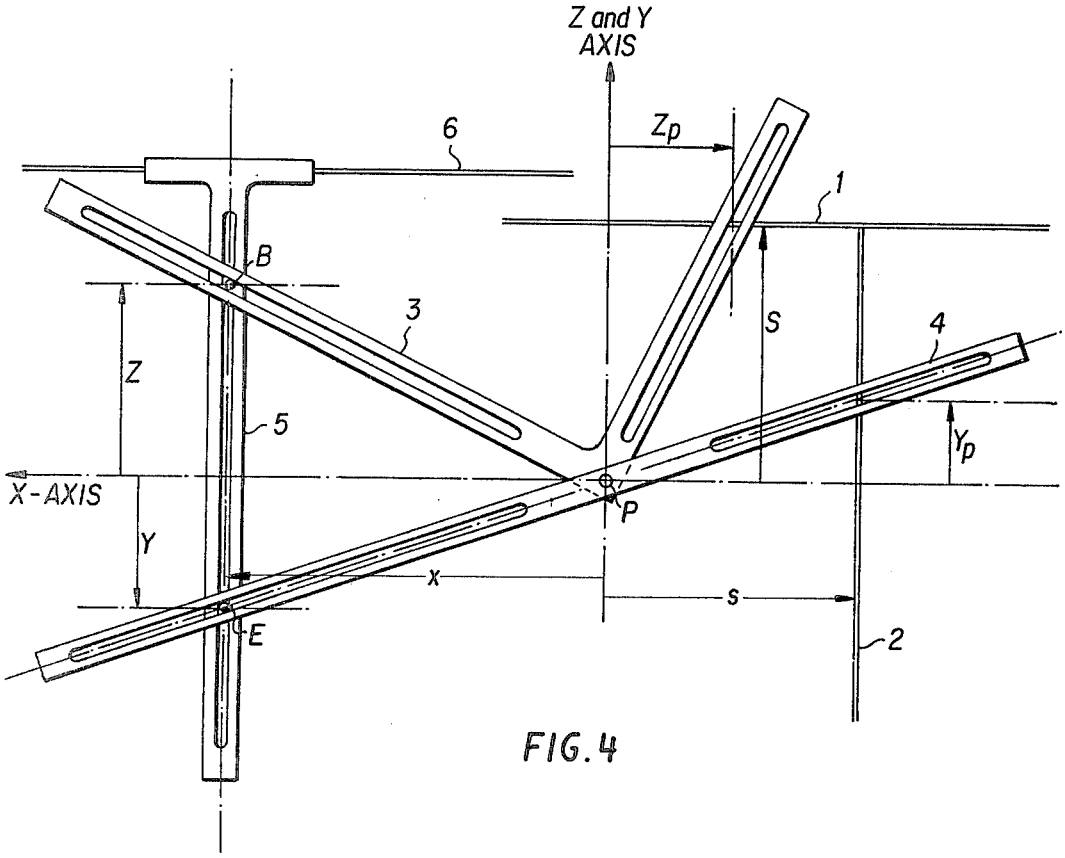
FIG. 4 is an illustration of a combined $y_p$ and $z_p$ mechanisms as shown in FIGS. 2 and 3 with a bar to cause sharing of the x dimension.

As will be discussed and illustrated in greater detail, the apparatus of the invention makes the above transformations for distances z and y into their corresponding distances $z_p$ and $y_p$ by combining two mechanisms which share the x and s distances, with the s distance typically held constant during a transformation or operation of the apparatus and with the x and z distances variable. One embodiment of the invention which satisfies this perspective requirement is the combination of the apparatus shown in FIG. 2 with the apparatus shown in FIG. 3 to result in the apparatus as illustrated in FIG. 4.

Figure 2:
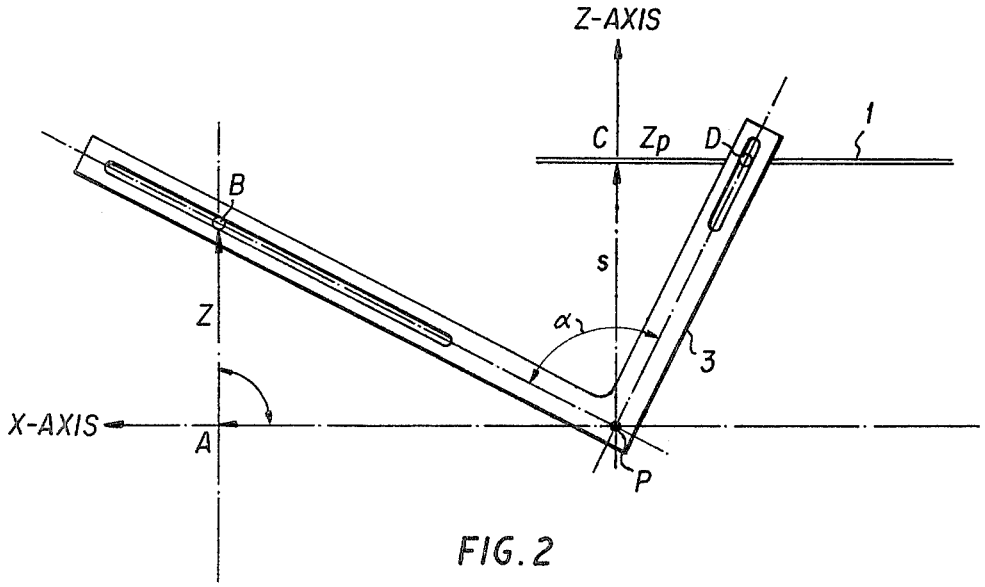
FIG. 2 is an illustration of a $z_p$ mechanism which transforms the z dimension into the $z_p$ dimension.

In particular, FIG. 2 discloses an apparatus which makes the transformation from distance z into distance $z_p$. FIG. 3 discloses a device which makes the transformation of distance y into distance $y_p$. In both mechanisms, reference character P signifies a fixed axis or pivot corresponding to the viewpoint during a transformation. In addition, horizontal track 1 and vertical track 2 are fixed in position.

In the $z_p$ mechanism illustrated in FIG. 2, if the x-z plane is taken as indicated, then the input point (x,z) from the object will produce the output indicated by equation 3, as required. In the $y_p$ mechanism illustrated in FIG. 3, if the x-y plane is taken as indicated, then an input point (x,y) will produce the output as indicated by equation 4, as required.

With respect to the geometry of the apparatus of FIGS. 2 and 3 it is important to note that the angle $\alpha$ of guide-bar 3 is arbitrary and it is only necessary and critical that the triangles PAB and PCD be similar triangles. In a corresponding manner, angle $\beta$ of guide-bar 4 is arbitrary and it only necessary and critical that the triangles PEF and PGH be similar.

In other words, the geometries of the mechanisms do not need to replicate the geometry illustrated in FIG. 1. In fact, it is only necessary that the geometries of the apparatus of FIGS. 2 and 3 only preserve the required ratios of the perspective illustrated in FIG. 1. Right triangles are used herein for convenience and illustration only. In a practical sense, if angles $\alpha$, $\beta$ and $\delta$ are all 90° angles, and $\beta=\alpha+90°=180°$, then both inputs and outputs will be in orthogonal frames and $z_p$ and $y_p$ will be generated orthogonal to one another if the x-axis of the two figures are parallel or superimposed. In should also be noted that tracks 1 and 2 and slotted bars 3 and 4, as well as the other tracks and slotted bars illustrated in this disclosure, are used for clarity in demonstrating the motions of the moving and fixed points. It is readily apparent to one skilled in the art that such structure is not the only means for insuring the proper motions and geometries employed by the disclosed invention and that other techniques are available.

In the preferred embodiment, the mechanisms illustrated in FIGS. 2 and 3 are combined and coupled to have the same x and s distances by overlying the bar mechanisims to share viewpoint P and adding a coupling bar which will ensure that both have the same x distance. Such a combined mechanism is illustrated in FIG. 4. Coupling bar 5 is mounted on a second horizontal track 6 which is parallel to the horizontal track 1 so that the coupling bar 5 is constrained to move with its slot 5s always perpendicular to the x-axis. The result is that points B and E will share the x distance. The combined mechanism of FIG. 4 generates the $z_p$ and $y_p$ coordinates from the coordinates (x, y, z) and the scale factor distance s. As mentioned previously, the scale factor distance s, preselected for a given perspective, is arbitrary and may be selected or set to scale the size of the output.

Figure 5:
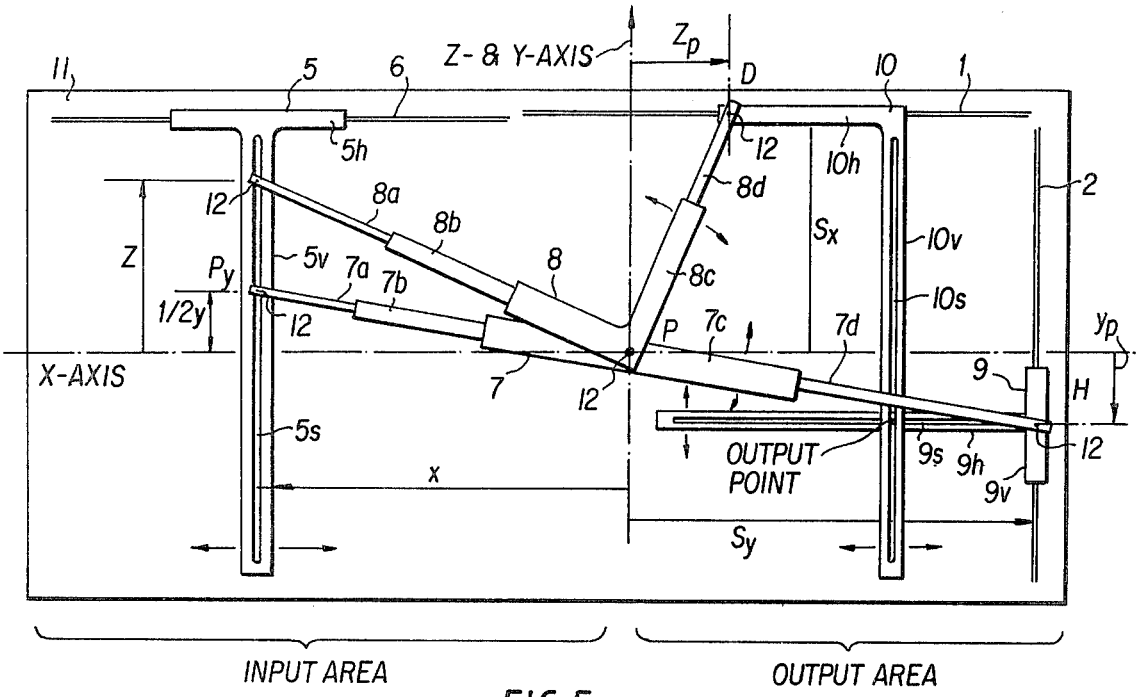
FIG. 5 is an illustration of another embodiment of the combined mechanism of FIG. 4 with plotter bars and scribers added to the output area to define an output point.

FIG. 5 illustrates the preferred embodiment of the invention with telescoping straight bar 7 replacing slotted straight bar 4 ($y_p$ bar) and telescoping bar 8 replacing the slotted bar 3 ($z_p$ bar). In addition, the apparatus illustrated in FIG. 5 includes an output/plotter mechanism. For the sake of simplicity of the drawing, details of the mechanism permitting the telescoping elements to cross the axis at viewpoint P and details of the scriber and elements permitting variations of the s distance (i.e. $s_x$ and $s_y$) are not shown. It is contemplated that variation of the s distance may be achieved by, for example, use of tracks mounted on the output bars perpendicular to their respective tracks which permit the vertical repositioning of point D and the horizontal repositioning of point H. Alternatively, output tracks 1 and 2 may be structured for movement to achieve the same result.

In the device of FIG. 5, it is important to note that $s_y$ is set at $s_y=2s_x$ so that $p_y$ (elevation) must be set $\frac{1}{2}y$. This insures that the proper geometry will remain as follows:

$$\tfrac{1}{2}y/x=y_p/2s_x \quad \text{so that} \quad y_p=s_x(y/x)$$

The result is that the same $s=s_x$ applies in both transformations. Referring to the output/plotter mechanism in the output area of the device, it can be appreciated that bar 9 with horizontal slot 9s is mounted onto vertical track 2 and carries one end of telescoping straight bar 7. Bar 10 is mounted on horizontal track 1 so that slot 10s is constantly vertical and one end of telescoping bar 8 is carried with the bar 10 along horizontal track 1.

The intersection of vertical slot 10*s* and horizontal slot 9*s* provides the plotter/scriber output point.

Referring in more detail to the particular structure of the device illustrated in FIG. 5, it it generally contemplated that the system is mounted on a drafting table 11 for convenience. Horizontal tracks 1 and 6 and vertical track 2 are permanently affixed to the table 11 and may be in the form of a rod, cable, bar, or slot. Coupling bar 5 rides along the second horizontal track 6 so that the top 5*h* of the bar rides within or is carried on the second horizontal track 6 whereas the vertical 5*v* of the bar is held perpendicular to the second horizontal track 6. Vertical 5*v* includes a slot 5*s* for guiding the telescoping ends of bars 7 and 8. In particular, telescoping straight bar 7 includes telescoping members 7*a*, 7*b*, 7*c* and 7*d*. Member 7*a* has one end which telescopes into member 7*b* and has another end which is connected to vertical 5*v* by pin 12. In fact, pin 12 is carried within slot 5*s* so that the end of member 7*a* may move vertically within the slot s and perpendicular to the horizontal track 6. Similarly, one end of member 7*d* telescopes into member 7*c* and the other end of member 7*d* is connected to bar 9 by pin 12.

In a comparable manner, telescoping bar 8 is comprised of members 8*a*, 8*b*, 8*c* and 8*d*. One end of member 8*a* telescopes into member 8*b* and the other end of member 8*a* is engaged with slot 5*s* via pin 12. One end of member 8*d* telescopes into right angle member 8*c* and the other end of member 8*d* is connected by pin 12 to L-bar 10. Right angle 8*c* and member 7*c* are hingedly connected by pin 12 at viewpoint P.

Referring in more detail to the output/plotter mechanism, bar 10 is comprised of horizontal portion 10*h* and vertical portion 10*v* with slot 10*s* therein. Horizontal portion 10*h* rides in or is carried on horizontal track 1 and has one end which is pinned to member 8*d* by pin 12 and another end which is perpendicularly connected to vertical member 10*v*. 9 is comprised of horizontal portion 9*h* and is carried or rides in vertical track 2 and pin 12 interconnects member 7*d* at the intersection of horizontal portion 9*h* and vertical portion 9*v* so that the end of member 7*d* rides along the vertical track 2. The result is that the intersection of slots 9*s* and 10*s* provide the output point for perspective drawing.

Figure 6:
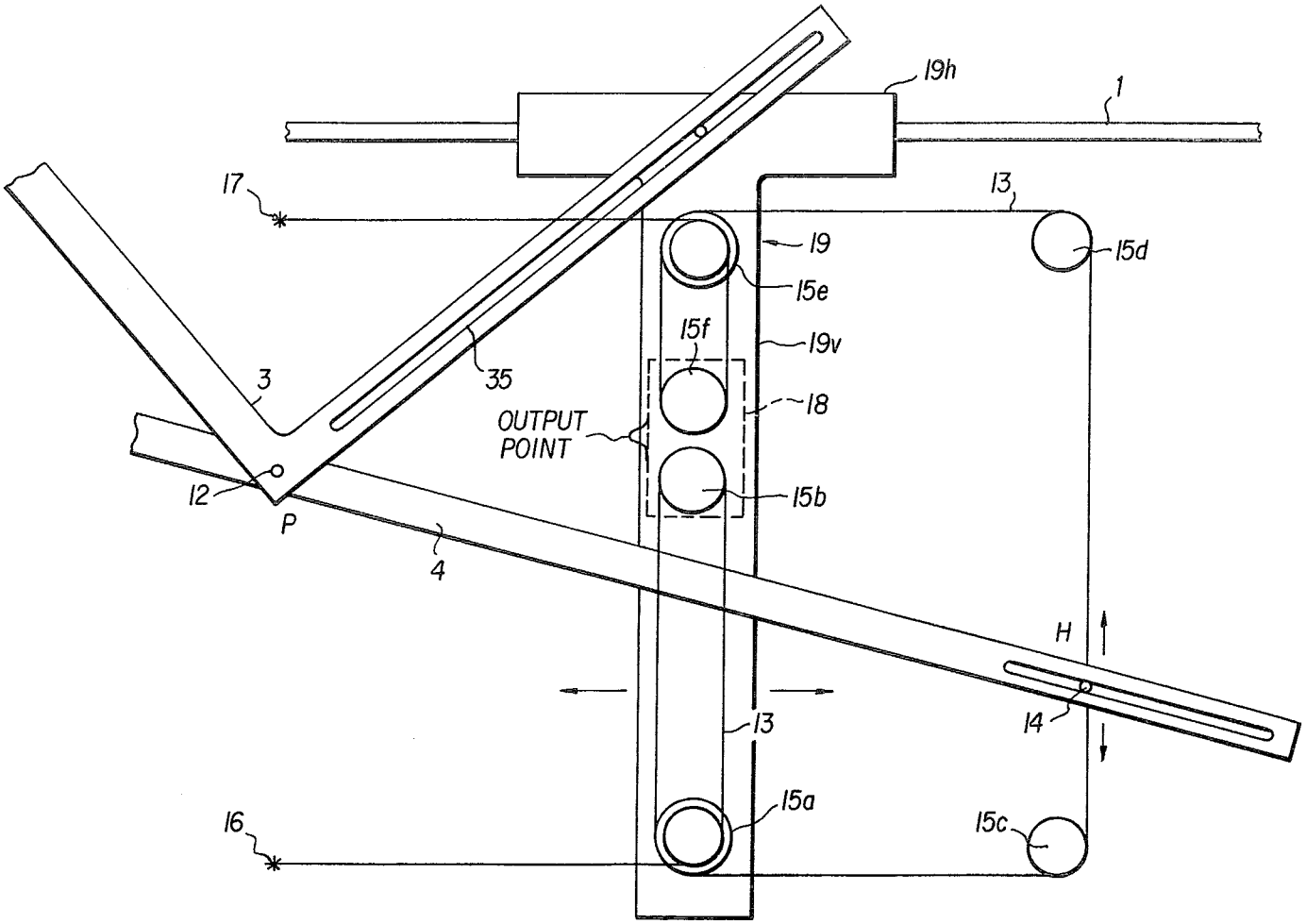
FIG. 6 is an illustration of another embodiment of the invention as shown in FIG. 5 wherein a pulley-cable arrangement eliminates the need for a $y_p$ output-plotter bar.
Figure 8:
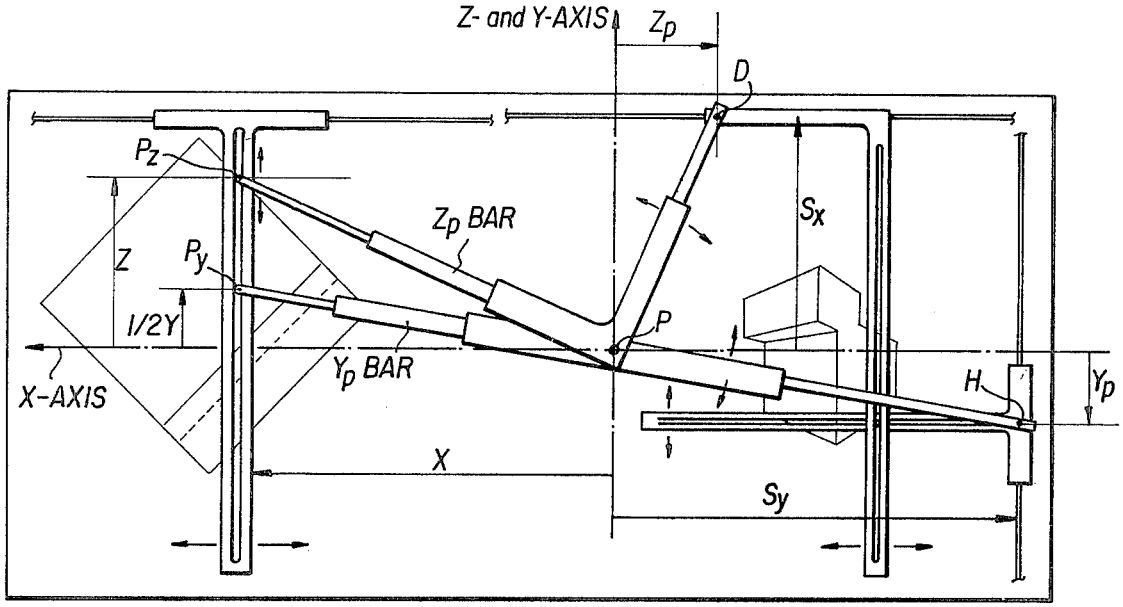
FIG. 8 is an illustration of the combined mechanism of FIG. 5, showing schematically an input plan and resultant output.
Figure 9:
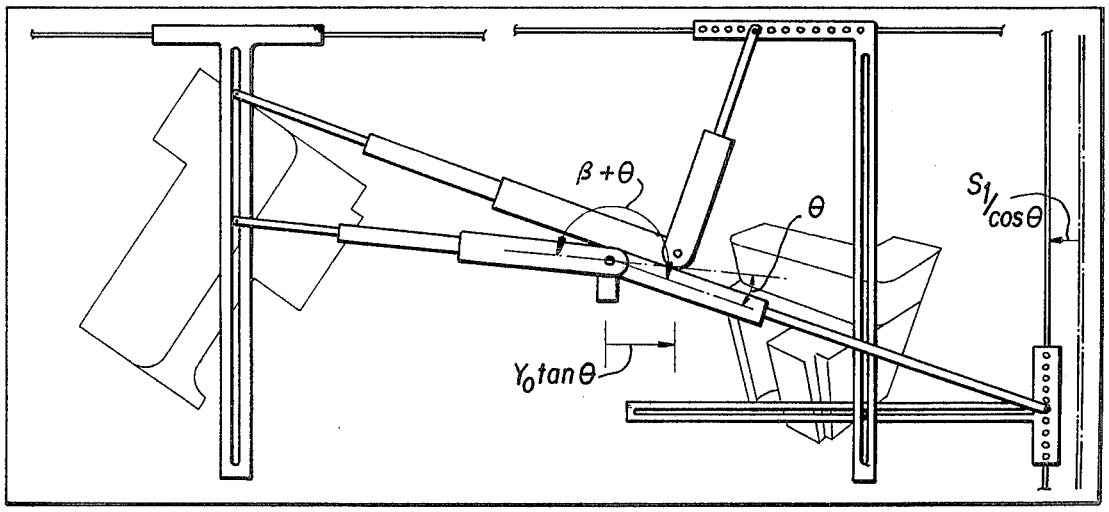
FIG. 9 is an illustration of the combined mechanism of FIG. 5, wherein angles $\alpha$ and $\beta$ are adjustable, the pivot or hinge points of the $y_p$ and $z_p$ bars are relocatable, and the vertical guide track for the horizontal plotter bar is relocatable, and wherein settings are made for an angle of view $\theta$, thereby producing a third point perspective view.

FIG. 6 illustrates an alternative embodiment of the device of FIG. 5. In particular, the pulley/cable system of FIG. 6 permits the elimination of the bar 9 which is the $y_p$ output/plotter bar. Slotted straight bar 4 is hinged by pin 12 to slotted bar 3 and has a slot therein which attaches to cable 13 via head 14. Cable 3 has one end affixed to the table at point 16. Cable 13 is wound around the upper roller of double 15*a*, around roller 15*b*, and back around the lower roller of double roller 15*a*. The cable subsequently engages rollers 15*c* and 15*d* with the bead 14 located therebetween. The lower roller of double roller 15*e* is then engaged so that the cable may wind around roller 15*f* and back around the upper roller of double roller 15*e* for fixation of the other end of the cable at point 17. Rollers 15*b* and 15*f* are carried on trolley 18 which designates the plotter/scriber output point.

Alternatively, such a pulley/cable system could be used to eliminate the $z_p$ output/plotter bar instead. The trolley 18 is constrained to move along the $z_p$ output bar which is vertical portion 19*v* of bar 19. Portion 19*h* of the bar engages the horizontal track 1. The horizontal portion 19*h* is connected to slot 3*s* of slotted bar 3 by pin 12.

This alternative embodiment illustrated in FIG. 6 is structured to function as the embodiment in FIG. 5 because the bead 14 is constrained to move in the vertical track defined by rollers 15*c* and 15*d* engaged by cable 13. The result is that point H is required to move as the $y_p$ bar. Such motion of point H, as the $y_p$ bar, causes the output trolley to move exactly as the $y_p$ output bar, i.e. the trolley motion designates an output point which corresponds to the vertical position of point H. However, in the cable arrangement illustrated in FIG. 6, the elevation y has the reverse sign as the $y_p$ bar arrangement. This distinction has no adverse affect on the apparatus and is unimportant for two-point perspective drawing. However, the negative y elevation actually provides a benefit in that upward movement of the y input will result in upward movement of the $y_p$ output and, similarly, downward movement of the y input will result in downward movement on the bar of the $y_p$ output.

Note that a constant multiplier may be introduced into equations (3) and (4), e.g. for convenience in proportioning the mechanisms as may be desired. For example, in equation 4, multiplying through by 1/r results in:

$$\frac{\frac{1}{r}y}{x} = \frac{1}{r}\,\frac{y_p}{s} \tag{5}$$

so that if $y_p/r$ is used in place of $y_p$, and rs instead of s for a scale factor for $y_p$, then the proper $y_p$ will still be generated. If r is taken to be 2, to give a specific example, and ½y is set on the input, and a scale factor 2s is used, then the output area will have a 2s (−s to +s) range in both y and z. A wide range of sizes and proportions of input and output fields is possible, and choice of various angles ($\alpha,\beta,\gamma$, etc.) subject only to restrictions already mentioned. Various choices may be made for particular desired input and output arrangements.

Using separate pivot points for the $y_p$ and $z_p$ bars can result in an expansion in the capability of the invention, a point discussed below.

If y is set and fixed, as through use of a tightening screw or clamp, for a selected "elevation" y relative to viewpoint P, then points (x,z) can be positions in a plan section of an object, at the elevation y. These plan sections could be e.g. floors of a building, contours on a contour map, or sections (selected suitably for convenience) of any object.

The horizontal plane at the elevation of the viewpoint P is y=0. Tracing the plans for sections or plans at various y's produces the corresponding transformed (perspective) views of the sections as seen from the viewpoint. If a suitable output device is incorporated, the trace by $P_z$ of the plan can be a continuous input-output process. A completed perspective view of the object can then be formed by putting in lines drawn from corresponding points section-to-section. This may be done either by hand with a straightedge, or by locking x and z and varying y. It may be noted that there are no restrictions on the sign of the elevation: y may be positive or negative. However, x must always be positive. As a practical consideration, various portions of the object would not be visible to the viewpoint, so that the corresponding portions of the sections would not need to be traced.

Figure 7:
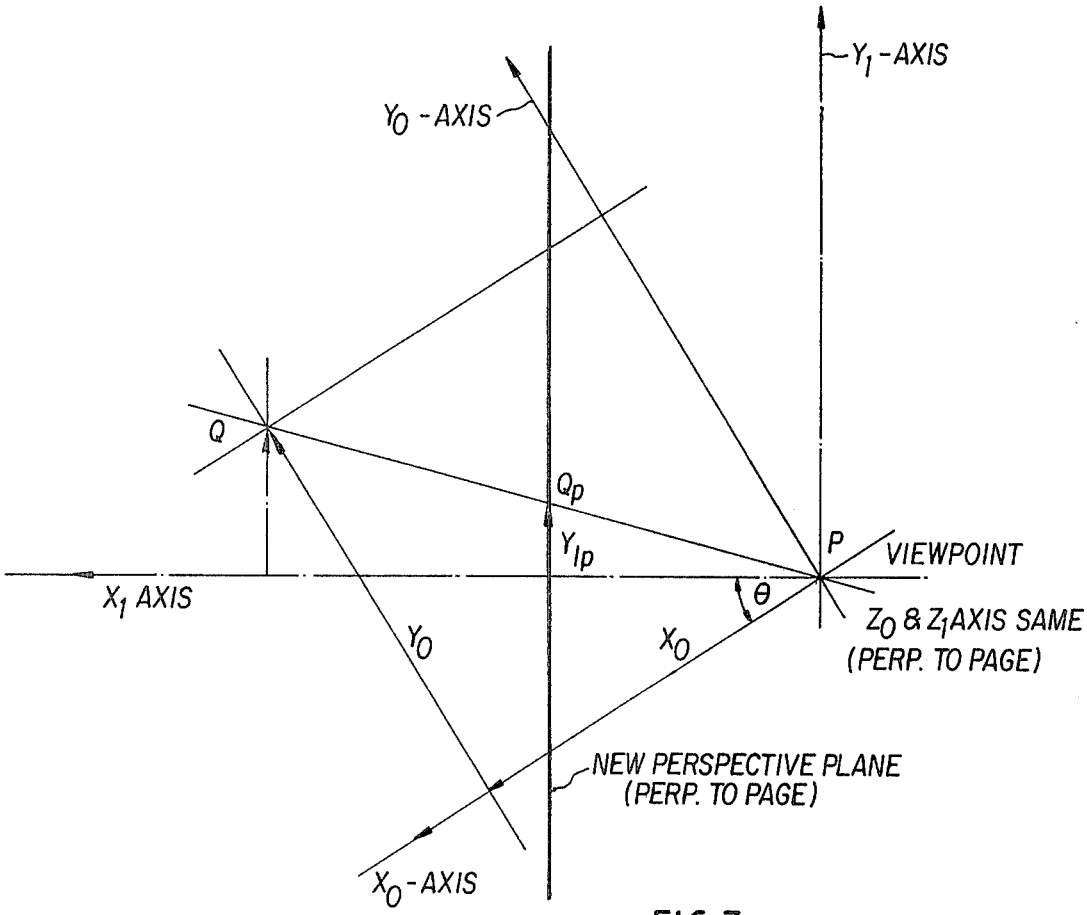
FIG. 7 is a side view illustrating the perspective transformation geometry wherein the angle of view is at an angle $\theta$ relative to the $x_o$-axis, and $z_o$, $z_p$, and $z_{1p}$ are perpendicular to the page.

In the foregoing, the effect of holding y constant for a elevation is typically to produce what are called one- and two-point perspective views, wherein the line of sight is perpendicular to the vertical, and sections are taken perpendicular to the vertical. In one- and two-point perspective views, the vertical lines do not converge (at great distances or infinity) but remain parallel in view, that is, in projection onto the perspective plane. If, however, the line of sight is not perpendicular to the vertical, then the vertical lines, as well as horizontal parallel lines which are not parallel to the perspective plane, will converge, so that so-called three-point perspective views are obtained. FIG. 7 shows the geometry of rotating the line of sight upwards to an angle $\theta$ to the original horizontal x-axis or line of sight, here labeled the x-axis. Reference character y is the vertical axis, and $y_1$ is the new apparent vertical—that is the "up and down" perpendicular to the line of sight ($y_1$-axis). The z-axis remains the same. The perspective plane is of course rotated by an angle $\theta$, since it must be perpendicular to the line of sight.

One advantage of the invention is that one need only trace sections in the x-z plane, resetting the elevation suitably but holding it fixed for a trace of a section. In order to utilize horizontal sections from the $x_o$-$y_o$ frame, or more generally parallel sections which are not parallel to the line of sight, the projection onto the new perspective plane must be figured in terms of the ($x_o$, $y_o$, $z_o$) of the sections. By the same discussion as above, the view in the new perspective plane is as follows:

$$y_{1p}=s_1(y_1/x_1) \tag{6}$$

and $$z_{1p}=s_1(z_1/x_1)=s_1(z_o/x_1) \quad \text{since } z_1=z_o \tag{7}$$

However, FIG. 6 requires:

$$y_{1p} = s_1 \frac{-x_o\sin\theta + y_o\cos\theta}{x_o\cos\theta + y_o\sin\theta} \tag{8}$$

and $$z_{1p} = s_1 \frac{z_o}{x_o\cos\theta + y_o\sin\theta} \tag{9}$$

It is easily shown that equation (8) is obtainable by changing $\beta$ to $\beta+\theta$ in FIG. 1 (or into $\beta-\theta$, with certain adjustments for sign). Equation (9) is obtainable by displacing the pivot P for the z-mechanism or transformation by an amount $y_o \tan\theta$ along the x-axis, and changing $s_1$ for this transformation into $s_1/\cos\theta$, since equation (9) can be written as:

$$z_{1p} = \frac{s_1}{\cos\theta} \frac{z_o}{x_o + y_o\tan\theta} \tag{10}$$

so that once $s_1$ is changed to $s_1/\cos\theta$ for the given $\theta$, it only requires that $x_o$ be incremented by $y_o \tan\theta$, a quantity which is constant for a given $\theta$ and setting of $y_o$, the vertical (in the original frame) elevation of the section being traced.

The geometrical relationships derived above and incorporated in the invention to produce $y_p$, $z_p$, and $y_{1p}$, $z_{1p}$, rely solely on the geometry of perspective projection or viewing and not on any use of so-called vanishing points. Holding y constant permits the transformation of the section at y into its perspective view, rapidly and easily through merely tracing out the outline of the section in the x-z plane. There have been no approximations; the accuracy of the invention depends only on the quality of the components used.

Various changes may be made in the details of the invention, as disclosed without sacrificing the advantages thereof or departing from the scope of the appended claims. For example, various components or parts may be mountable below the table or working surface. It contemplated that the portions of the $z_p$ bar and the $y_p$ bar may be mounted entirely below the table if the input bar runs both across the top and the bottom of the table by some means as a lever mechanism or cable and pulley system thereby carrying y and z below to the $y_p$ and $z_p$ bars. The viewpoint P need not be permanently fixed but can be reset to the left or right, or up or down, to satisfy a special condition of the desired viewpoint or for the 3-point perspective, as discussed above. Further, as already mentioned above, provision can be made for varying the distance s since the scale factor is set separately for $y_p$ and $z_p$. Using different scale factors for $y_p$ and $z_p$ will cause stretching of the view horizontally or vertically as may be desired for a stylistic effect. It is further contemplated that angles $\alpha$, $\beta$ and $\delta$ need not be right angles and a variety of configurations are possible. For example, repositioning of the relative positions or orientations of the input and output areas is contemplated. Finally, it is contemplated that there may be situations where the invention can be employed in reverse, that is, wherein a view on the output area is traced to produce a plan on the input area.

The invention makes possible the rapid development of perspective views of objects, especially when parallel sections are readily available. The device of the invention is relatively simple and its cost related directly to the quality and versatility of its functions, size-quality of materials and construction, whether elements are mounted below the table and so on. Thus, a simple version can be made at a cost competitive with inexpensive drafting machines thus making the devise available, for instance, to students. The disclosure herein contemplates elaborate, accurate and versatile versions which could serve those requiring such accuracy such as architects, designers and engineers.

What is claimed is:

1. An apparatus for creating perspective views on a drafting table comprising:

(a) first horizontal guide means (1) mounted on the table;

(b) second horizontal guide means (6) mounted on the table;

(c) first vertical guide means (2,13) mounted on the table and perpendicular to the first horizontal guide means (1);

(d) a first member (5) perpendicularly connected to the second horizontal guide means (6) for movement along the second horizontal guide means (6) such that said first member (5) is perpendicular to the second horizontal guide means (6), said first member (5) providing an input;

(e) a second member (4,7) having a first end connected to the first member (5) for slideable movement along the first member (5), a second end connected to the first vertical guide means (2,13) for slideable movement along the first vertical guide means (2,13), and center portion interconnecting the first end and the second end of the second member (4,7);

(f) a third member (3,8) having a first leg and a second leg, the first leg having a first end connected to the first member (5) for slideable movement along the first member (5), and the first leg having a trace point fixed thereto, the second leg having a second end connected to the first horizontal guide means (1) for slideable movement along the first horizontal guide means (1), the first and second legs intersecting at a viewpoint (P) and hingedly connected to said viewpoint (P) to the center portion of the second member (4,7) so that the trace point may be applied as a tracing input for the apparatus; and (g) an output plotting means comprising a fourth member (10,19) perpendicularly connected to the first horizontal guide means (1) and connected to said second end of the third member (3,8), said fourth member (10,19) connected for movement along the first horizontal guide means (1) such that said fourth, member (10,19) is perpendicular to the first horizontal guide means (1) and parallel to the first vertical guide means (2,13), and means (9, 13–15) connected to the second half of the second member (4,7) in a fixed relationship with the vertical position of a point in a fixed relationship to the second end of the second member (4,7).

2. The apparatus of claim 1 wherein the first member (5) is a bar having a horizontal portion (5*h*) slidable along the second horizontal guide means (6) and a vertical portion (5*v*) perpendicular to the horizontal portion (5*h*) and having a track or slot (5*s*) therein for guiding the movement of the first ends of the second and third members (3,4,7,8).

3. The apparatus of claim 1 further including a fifth member (9) perpendicularly connected to the first vertical guide means (2) and connected to the second end of the second member (4,7), said fifth member (9) connected for movement along the vertical guide means (2) such that said fifth member (9) is perpendicular to the vertical guide means (2) and parallel to the first and second horizontal guide means (1,6), the intersection of said fifth member (9) and said fourth member (10) defining the output point.

4. The apparatus of claim 3 wherein the fourth member (10) is a bar having a horizontal portion (10*h*) connected for parallel movement along the first horizontal guide means (1) and a vertical portion (10*v*) having a guide means (10*s*) therein; and said fifth member (9) is a bar having a vertical portion (9*v*) connected to the first vertical guide means (2) and a horizontal portion (9*h*) perpendicular to the vertical portion having a slot (9*s*) therein wherein the intersection of said slots (9*s*, 10*s*) of said fourth and fifth members (9, 10) defines the output point.

5. The apparatus of claim 3, wherein said first horizontal guide means (1) is a cable means.

6. The apparatus of claim 5, wherein said cable means includes a cable (13) for horizontal movement and connected to the second end of the first member (3,8) and a trolley (18) connected to the cable (13) and guided for horizontal movement along the fifth member (9,19), the trolley defining the output point.

7. An apparatus for creating perspective views on a drafting table comprising:

(a) first horizontal guide means (1) mounted on the table;

(b) second horizontal guide means (6) mounted on the table;

(c) first vertical guide means (2) mounted on the table and perpendicular to the first horizontal guide means (1);

(d) a first member (5) perpendicularly connected to the second horizontal guide means (6) for movement along the second horizontal guide means (6) such that said first member (5) is perpendicular to the second horizontal guide means (6) said first member (5) providing an input;

(e) a second member (4,7) having a first end connected to the first member (5) for slideable movement along the first member (5), a second end connected to the first vertical guide means (2) for slideable movement along the first vertical guide means (2), and center portion interconnecting the first end and the second end of the second member (4,7);

(f) a third member (3,8) having a first leg and a second leg, the first leg having a first end connected to the first member (5) for slideable movement along the first member (5), and the first leg having a trace point fixed thereto, the second leg having a second end connected to the first horizontal guide means (1) for slidable movement along the first horizontal guide means (1), the first and second legs intersecting at a viewpoint (P), and hingedly connected at said viewpoint (P) to the center portion of the second member (4,7) so that the trace point may be applied as a tracing input for the apparatus; and (g) a horizontal member (9) perpendicularly connected to the first vertical guide means (2) and connected to the second end of the second member (4,7), said horizontal member (9) connected for movement along the first vertical guide means (2) such that said horizontal member (9) is perpendicular to the vertical guide means (2) and parallel to the first and second horizontal guide means (1,6), a vertical member (10) sliding along the first horizontal guide means (1) and connected to the second end of the third member (3,8) such that an output point is defined as the intersection of the horizontal and vertical members (9 and 10).

8. The apparatus of claim 3 or 7, wherein the first horizontal and vertical guide means (1,2) each may be repositioned, either perpendicularly or parallel to their lengths, or both.

9. The apparatus of claim 1 or 7 wherein the center portion of the second member (4,7) forms a 180° angle between the first end and the second end of the second member (4,7); and the center portion of the third member (3,8) forms a 90° angle between the first end and the second end of the third member (3,8).

10. The apparatus of claim 1 or 7 wherein said second member (4,7) and said third member (3,8) are each telescoping members (7,8).

11. The apparatus of claim 1 or 7, wherein the hinging of the center portion of the third member (3,8) and of the second member (4,7) are located independently and movably.

12. The apparatus of claim 1 or 7, wherein the center portion of the second member (4,7) forms an angle which can be adjusted, between the first and the second end of the second member (4,7), and the center portion of the third member (3,8) forms an angle which can be adjusted, between the first end and the second end of the third member (3,8).

13. The apparatus of claim 1 wherein said first vertical guide means (2,13) is a cable means.

14. The apparatus of claim 5 wherein said cable means includes a cable (13) supported for vertical movement and connected to the second end of the second member (4,7) and a trolley (18) connected to the cable (13) and guided for vertical movement along the fourth member (10,19), the trolley defining the output point.

* * * * *